United States Patent [19]

Tada

[11] 4,253,394

[45] Mar. 3, 1981

[54] PRINTING APPARATUS

[75] Inventor: Eiji Tada, Tokyo, Japan

[73] Assignee: Kabushiki Kaisha Tada Seisakusho, Japan

[21] Appl. No.: 35,202

[22] Filed: Apr. 30, 1979

[30] Foreign Application Priority Data

| | | | |
|---|---|---|---|
| Jun. 13, 1978 | [JP] | Japan | 53-71341 |
| Oct. 13, 1978 | [JP] | Japan | 53-125754 |
| Oct. 18, 1978 | [JP] | Japan | 53-143134 |
| Oct. 19, 1978 | [JP] | Japan | 53-143844 |
| Dec. 23, 1978 | [JP] | Japan | 53-178241 |

[51] Int. Cl.[3] ..... B41F 3/02; B41F 3/68

[52] U.S. Cl. ..... 101/250; 101/382 MV; 101/268; 74/384

[58] Field of Search ..... 74/380, 384; 101/234, 101/382 MV, 250, 269, 268, 270

[56] References Cited

U.S. PATENT DOCUMENTS

| | | | |
|---|---|---|---|
| 1,079,325 | 11/1913 | Blue | 101/269 |
| 1,822,301 | 9/1931 | Lee | 101/269 |
| 2,905,001 | 9/1959 | Courtney et al. | 74/384 |
| 3,067,676 | 12/1962 | Dickerson | 101/250 |
| 3,125,951 | 3/1964 | Lyman et al. | 101/250 |
| 3,556,007 | 1/1971 | Schulze | 101/250 |
| 3,608,485 | 9/1971 | Schulze | 101/269 |
| 3,736,869 | 6/1973 | Matter et al. | 101/153 |
| 3,795,191 | 3/1974 | Miller et al. | 101/269 |
| 3,804,013 | 4/1974 | Martin | 101/250 |
| 3,820,458 | 6/1974 | McInnis | 101/269 |
| 3,943,786 | 3/1976 | Mills | 74/384 |

FOREIGN PATENT DOCUMENTS

| | | | |
|---|---|---|---|
| 368390 | 3/1932 | United Kingdom | 101/250 |

OTHER PUBLICATIONS

Palmer, *Magnetic Paper Gripping Concept,* Xerox Disclosure Journal, vol. 3, No. 2, p. 107, Mar./Apr. 1978.

*Primary Examiner*—William Pieprz
*Attorney, Agent, or Firm*—McGlew and Tuttle

[57] ABSTRACT

Disclosed are a printing method for obtaining an outline design for child's painting and other simple printing materials, which comprises placing an embossed pattern plate, carbon paper and a sheet of paper to be printed on a printing frame in this sequence; and allowing the printing frame holding thereon the embossed pattern plate, carbon paper, and sheet of paper to pass through a spacing between a pair of rollers consisting of upper and lower rollers which are disposed in parallel and spaced from each other at a space substantially equal to the thickness of said printing frame, to transferring onto the sheet of paper the pattern of the outline design on the embossed plate under the pressure of said rollers, and an apparatus for carrying out such method, which comprises a main body including a main mechanical unit equipped with upper and lower rollers disposed in parallel, spaced from each other and adapted to be rotated by a driving means; and a printing frame which is adapted to receive thereon an embossed pattern plate, carbon paper and a sheet of paper in this sequence and allowed to pass between the parallel-rollers.

7 Claims, 10 Drawing Figures

PRINTING APPARATUS

BACKGROUND AND FIELD OF THE INVENTION

The present invention relates to a novel printing method and an apparatus adapted for practicing the method, more particularly, to a printing method and apparatus which allow children or non-professionals to easily print papers such as drawing papers, post cards and writing papers, by a simple handle operation or the like.

SUMMARY OF THE INVENTION

The object of this invention is to provide a novel printing method and an apparatus for practicing the method, which method and apparatus are principally suited to allow children to produce so-called children's paintings, i.e. outline drawings for subsequent coloring, and other simple printed materials and which apparatus is suitably adapted as a teaching aid for in-school education or as an educational toy at home.

Another object of this invention is to provide a handy and simple printing apparatus which is suitable for making the above-described printed items and which can be assembled or disassembled easily.

According to this invention, there is provided a printing method comprising placing an embossed or engraved pattern plate (which hereinafter will be referred to as "an embossed plate" for simplicity), carbon paper and a sheet of paper to be printed, on a printing frame in this order or sequence; and allowing the printing frame with the embossed plate, carbon paper and sheet of paper to pass through a through-pass or spacing between a pair of rollers consisting of upper and lower rollers which are disposed in parallel to each other and spaced from each other at a space substantially equal to the thickness of the printing frame, for transferring onto the sheet of paper the pattern or outline drawing on the embossed plate under the pressure of said rollers.

The present invention also provides a printing apparatus comprising a main body including a main mechanical unit equipped with upper and lower rollers spaced from each other, disposed in parallel and adapted to be rotated by a driving means; and a printing frame which is adapted to receive thereon an embossed plate, carbon paper and a sheet of paper in this order and allowed to pass between the parallel rollers.

The above-described printing apparatus further includes a housing which forms in its upper surface a lowered portion having a flat bottom surface, opening upwardly and frontwardly of the housing, with a width approximately equivalent to that of the printing frame and a through-path for the printing frame which through-path extends longitudinally of the housing from the front wall to the rear end of the rear portion of the housing at substantially the same level and width as those of the bottom surface of the lowered portion.

The main mechanical unit includes the parallel rollers which are disposed within the rear portion of the housing horizontally over substantially the entire width of the housing in such a manner that the upper and lower rollers are positioned respectively above and below the through-pass at a space substantially equal to the thickness of the printing frame, and support means rotatably receiving the rollers at both ends thereof. Each of said rollers are fixedly equipped with a small gear, at its left-hand or right hand extrimity, each having the same diameter and number of teeth and being in engagement with each other. These upper and lower rollers are rotated by means of a driving means such as manual handle or electric motor through means of a gear system associated with the small gear of either one of the upper and lower rollers.

In addition, a transverse axle is rotatably provided, in parallel with the upper and lower rollers, at approximately the middle portion of and below the flat bottom surface of the lowered portion of the housing. The transverse axle rotates co-operatively with the rollers by means of an endless belt extending between a pulley or belt wheel mounted on the transverse axle at the right-hand or left hand extremity and another pulley or belt wheel mounted on the lower roller at the right-hand or left-hand extremity thereof. The transverse axle is, at its suitable portion, fixedly provided with one or more feeding wheels in such a manner that an upper portion of each feeding wheel protrudes above the flat bottom surface of the lowered portion of the housing. The feeding wheels as well as the upper and lower rollers are so provided as to have such dimensions as each outer peripheral surface thereof rotates by a same distance.

If necessary, a rubber roller to prevent the upper roller from warping may be provided above the upper roller at the middle portion thereof so as to be rotatably in contact with the surface of the upper roller.

It is preferable to form the support means of the main mechanical unit by providing a plate-like frame equipped with a pair of downward support plates or walls of hard plastics or the like at both extremities thereof; forming through these support plates or walls, two pairs of roller holes, each pair of holes transversely facing each other and two holes of each plate or wall being in upper and lower relationship; inserting removably into the corresponding holes the upper and lower rollers from the left-hand side or right-hand side in order to dispose the upper and lower rollers transversely, parallelly and rotatably between the support plates or walls.

It is desirable to construct the gear system, for rotating the upper and lower rollers, in the main mechanical unit by fixedly mounting a spur gear on the shaft of the manual handle or the like so as to have said spur gear associate with the small gear of the upper roller through means of a transmission gear, or by interposing between the manual handle or the like and the parallel rollers clutch means which, when the manual handle or the like is rotated in the positive direction, transmits its positively-directed rotary power to the parallel rollers as feeding power for the printing frame and which, when the manual handle or the like is rotated in the reverse direction, does not transmit its reversely-directed rotary power to the parallel rollers.

It is preferable to construct the clutch means by fixedly mounting a sun gear about the shaft of the manual handle, providing a planetary pinion which is in engagement with the sun gear, freely inserting a central axle of the planetary pinion into a guide slot formed in one of the support plates so as to bring the planetary pinion into engagement with the transmission gear when the central axle of the planetary pinion has approached the inner extremity of the slot and to release such an engagement when the central axle has moved to the outer extremity of the slot.

The printing frame may preferably be formed by constructing a base plate, made of hard synthetic resinous material, having integrally at the peripheral edge thereof an upwardly surrounding frame or flange to form in its inside area a lowered flat area with the depth substantially equal to the thickness of the embossed plate which is placed thereon; spreading a resilient sheet such as a sponge sheet on the bottom of the base plate; and, in order to safely hold an embossed plate, carbon paper and a sheet of paper to be placed thereon, pivotally mounting a holding-strip on a rear edge of the base plate.

It is preferable to construct the holding strip by openably and movably receiving a strip-like plate made of a magnetic metal plate at the rear edge of the base plate and by fixedly mounting on the upper surface of the rear end of the base plate a magnet adapted to attract the strip-like plate.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
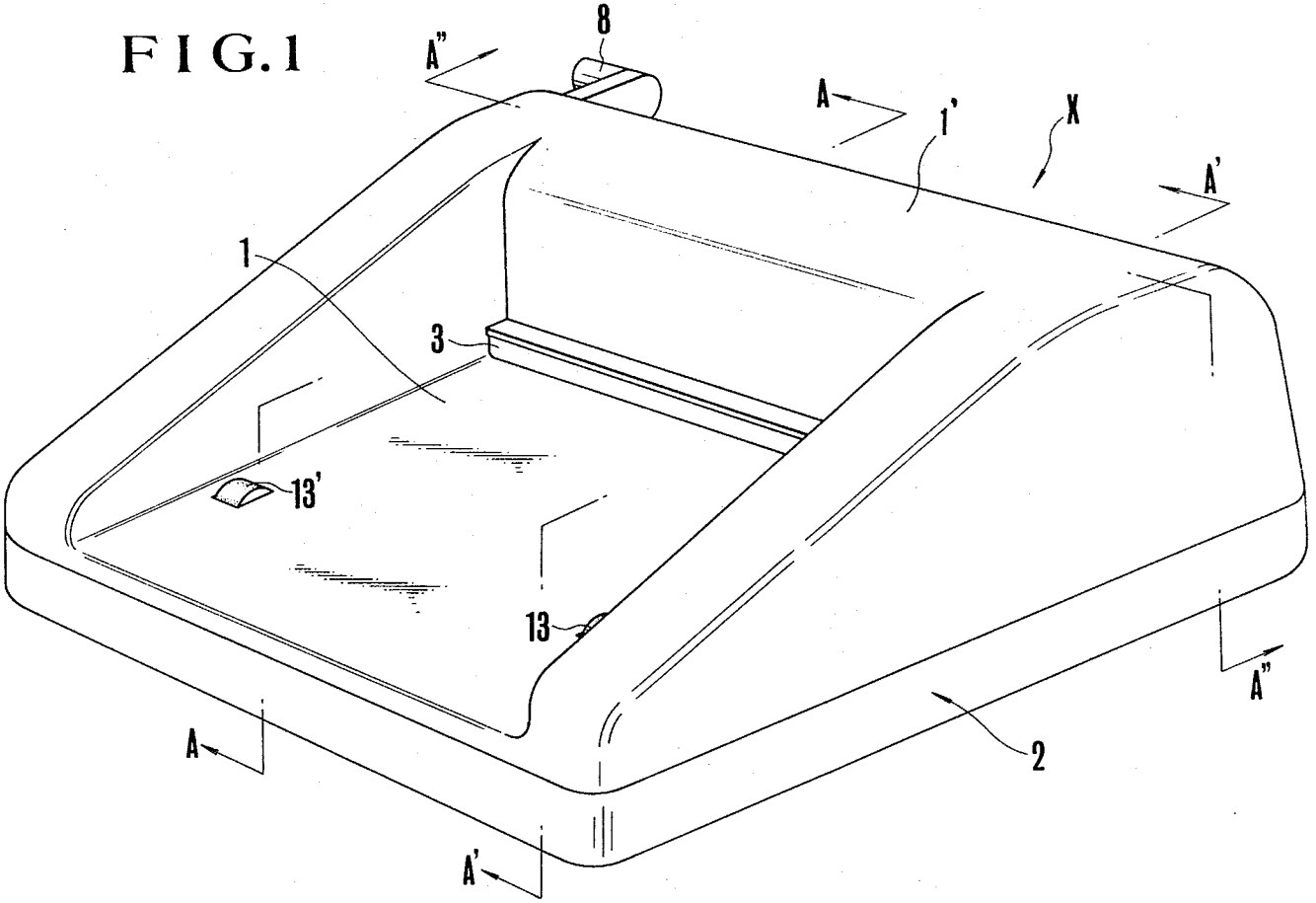
FIG. 1 is a perspective view showing the external appearance of the apparatus according to one embodiment of this invention.
Figure 2:
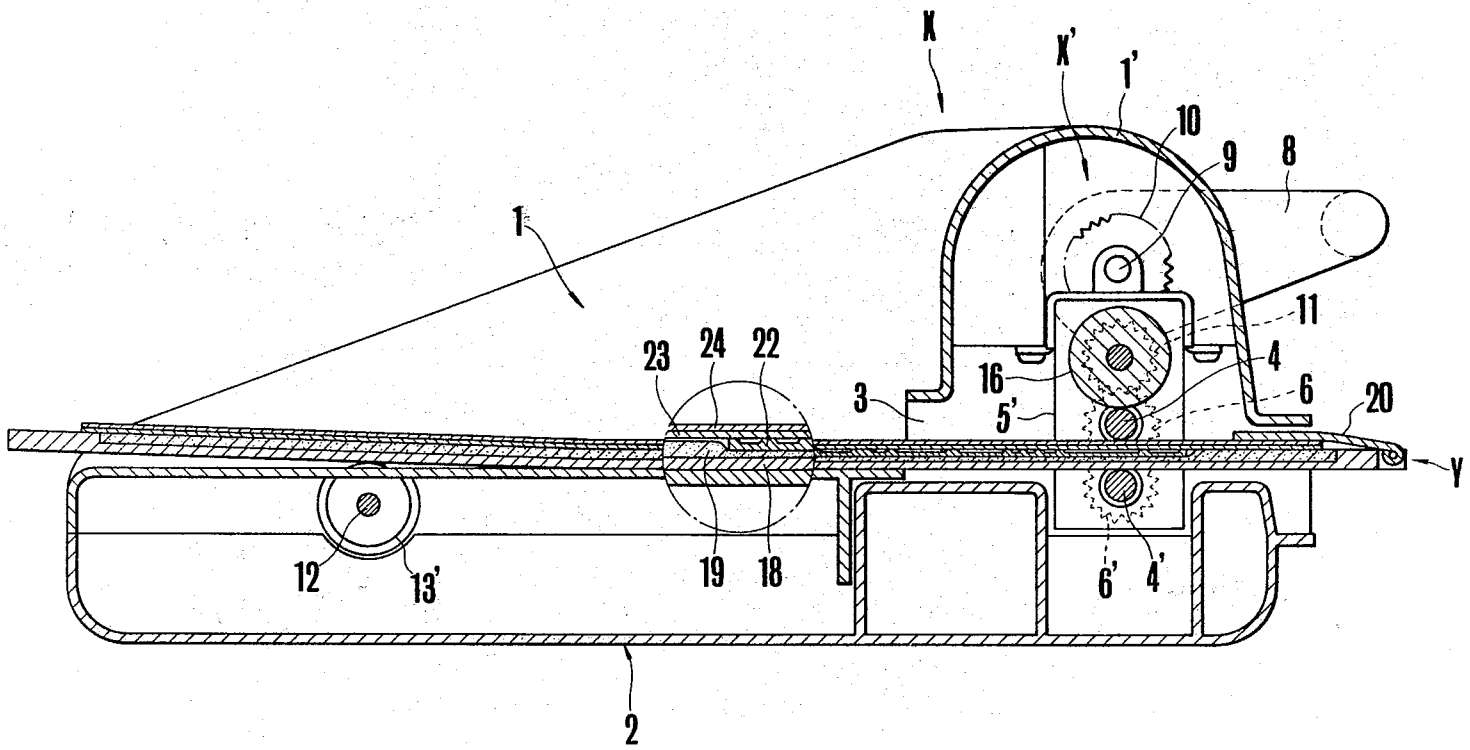
FIG. 2 is a cross-sectional view taken along the line A—A in FIG. 1.

In the embodiment shown in FIGS. 1 through 5, a housing 2 has, as best shown in FIG. 1, a sunken or lowered portion 1 whose bottom is flat and which opens upward and frontward with substantially the same width as that of the printing frame Y which will be herein explained later. There is formed a through-path 3 which extends longitudinally through the housing 2 from the front wall to the rear end of the rear portion 1' of the housing at substantially the same level and width as the bottom surface of the lowered portion 1. As shown in FIGS. 2 and 4, a pair of parallel rollers, upper and lower rollers 4, 4' are disposed horizontally, respectively above and below the through-path 3. The upper and lower rollers 4, 4' are rotatably received at both ends thereof by a pair of support plate 5, 5', which are disposed within the rear portion 1' of the housing 2 along both sides thereof. The upper and lower rollers 4,4' are fixedly provided with small gears 6, 6', at the left-hand extremities thereof, having the same teeth number and diameter and being disposed in engagement with each other.

A manual handle 8 is rotatably provided through the left-hand wall of the rear portion 1' of the housing 2. A spur gear 10 is fixedly mounted on the shaft 9 of the manual handle 8 and the spur gear 10 is associated with the upper small gear 6 through means of a transmission gear 11 to complete the formation of main mechanical unit X'.

Figure 3:
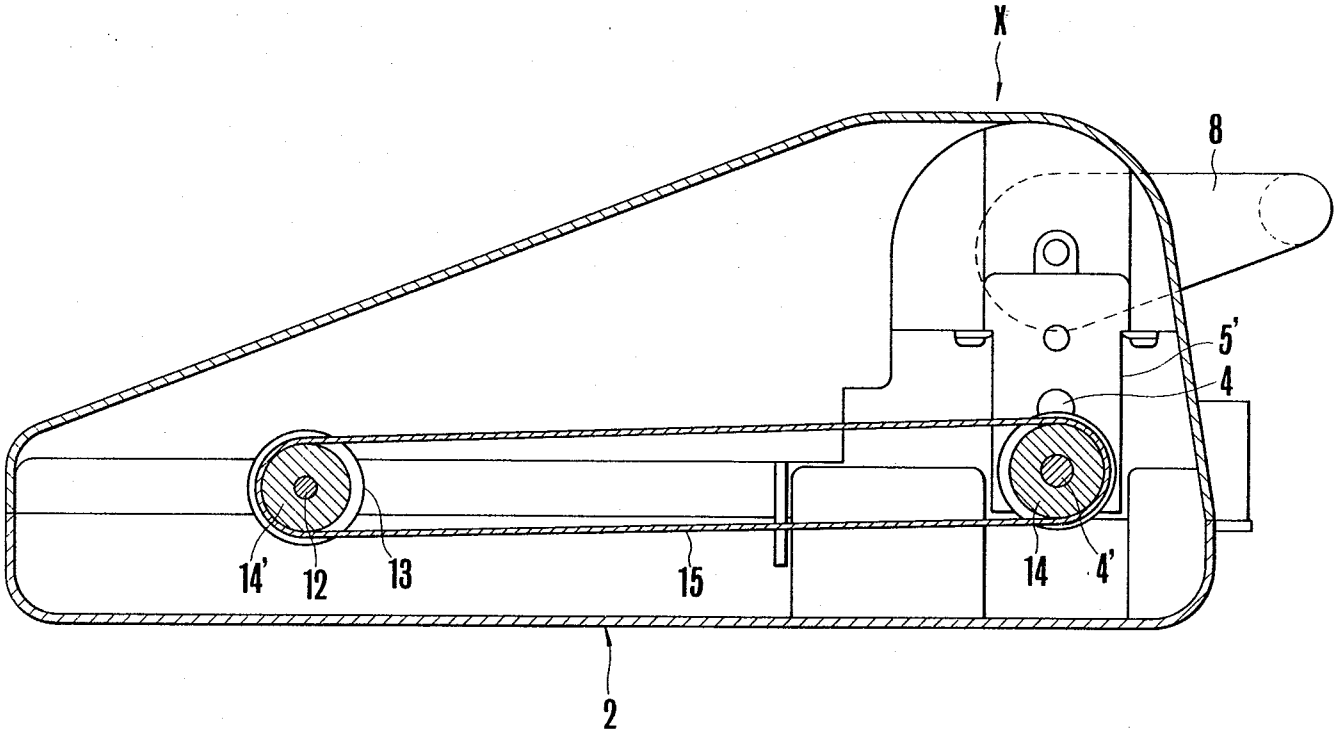
FIG. 3 is a cross-sectional view taken along the line A'—A' in FIG. 1.
Figure 4:
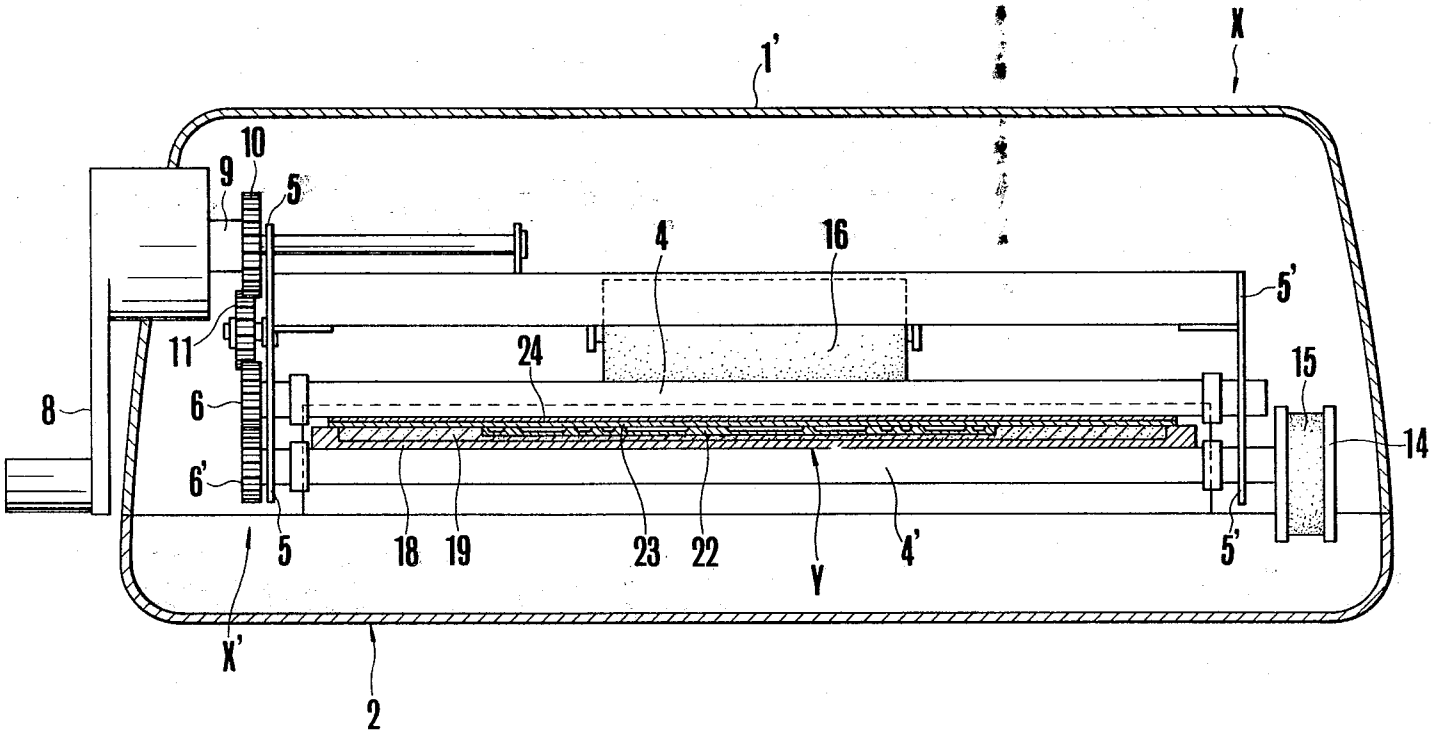
FIG. 4 is a cross-sectional view taken along the line A"—A" in FIG. 1.

Furthermore, as best shown in FIGS. 2 and 3, in the housing 2, a transverse axle 12 is disposed below the flat bottom of the lowered portion 1 at the middle portion thereof in parallel with the upper and lower rollers 4, 4'. Pulleys 14, 14' are respectively mounted on the right-hand end of the transverse axle 12 and the right-hand extremity of the lower roller 4', and between the pulleys 14, 14' is provided a rubber belt 15. Feeding wheels 13, 13' are provided on the transverse axle 12 in the vicinities of the both ends of the same in such a manner that upper portions of the feeding wheels 13, 13' protrudes upwardly through the bottom of the lowered portion 1.

The feeding wheels 13, 13' as well as the upper and lower rollers 4, 4' are so provided as to have such dimensions that each outer peripheral surface rotates by a same distance. A rubber roller 16 is also provided rotatably above the upper roller 4 to hold down the upper roller 4 thereby preventing the same roller from warping.

The main body X of the printing apparatus is thus constructed in the above manner.

Figure 5:
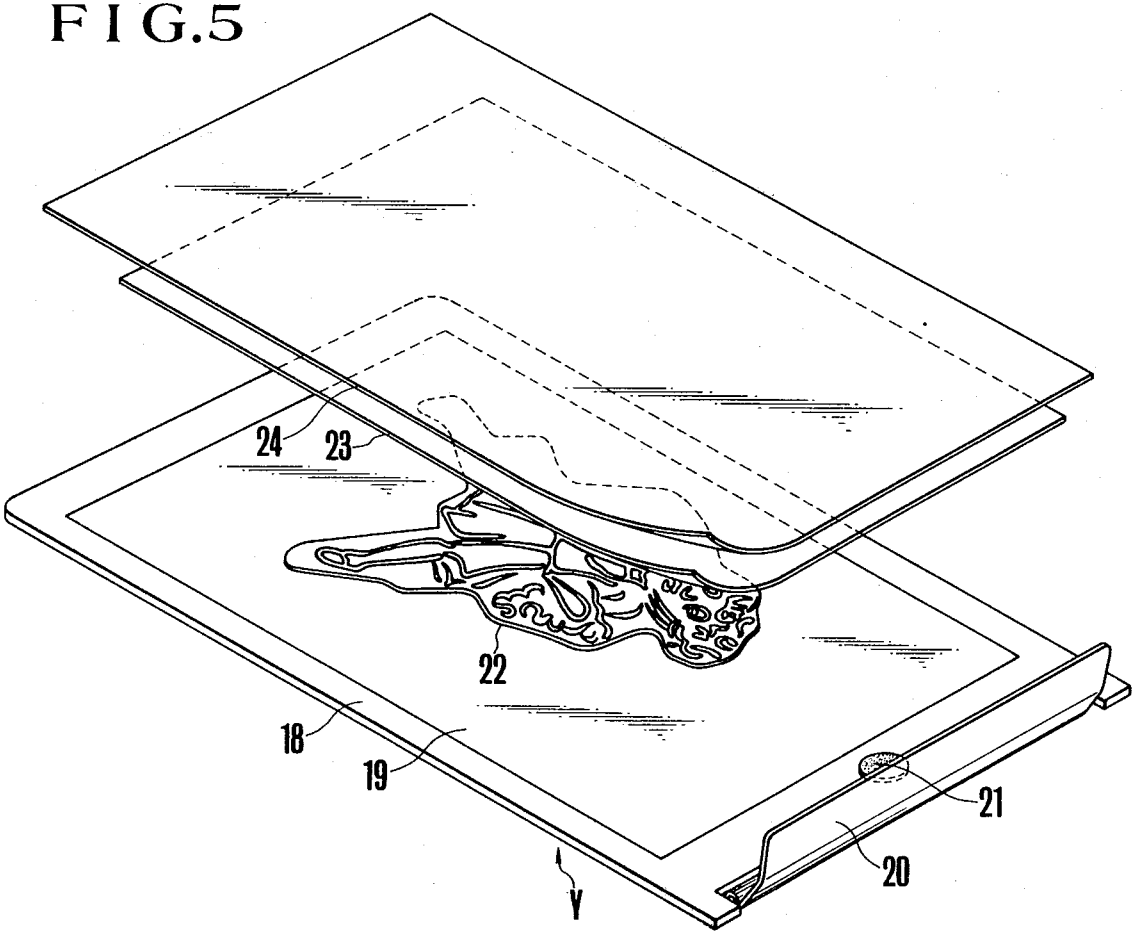
FIG. 5 is a perspective view showing the construction of a printing frame according to the present invention.

Apart from the main body X of the printing apparatus, a base plate 18 having a lowered or recessed flat area in the upper surface thereof is formed with a hard synthetic resinous material as shown in FIGS. 2, 4 and 5. Into the lowered or recessed flat area of the base plate 18, is spread a sponge sheet 19 and is pivotally disposed a holding plate 20 along the rear edge of the base plate 18 thereby constructing a printing frame Y. The holding plate 20 may be a strip-like plate made of a magnetic metal plate and, as shown in FIG. 5, a magnet 21 which is adapted to attract the plate 20 may be fixedly mounted at a suitable place on the upper surface of the base plate 18.

On the sponge sheet 19 of the base plate 18 is placed an embossed plate 22, carbon paper 23 and a sheet of drawing paper 24 in this order or sequence. The carbon paper 22 with carbon surface facing the drawing paper 24, and drawing paper 24 are then held in place by inwardly bringing the holding plate 20 down onto the rear edges thereof.

Thereafter, the printing frame Y holding the embossed plate 22, carbon paper 23 and drawing paper 24 thereon is inserted from the lowered portion 1 of the housing 2 to the front end opening of the through path, making the rear edge of the printing frame Y hold between the parallelly-disposed upper and lower rollers 4, 4' by operating the handle 8. The printing frame Y is further fed rearwardly by successively turning the manual handle 8 to rotate the parallelly-disposed upper and lower rollers 4, 4' and the feeding wheels 13, 13', and thus the pattern or outline drawing of the embossed plate 22 (original printing block) is transferred onto the drawing sheet 24 by the aid of the carbon paper 23 under the pressure of said rollers 4, 4'.

FIGS. 6 to 10 show a more preferred embodiment of this invention. In this embodiment, the main mechanical unit X' of the main body X is constructed by fixedly securing a sun gear 40 about the attachment shaft 9 of a manual handle 8; freely inserting a central axle 43 of a planetary pinion 42 into a guide slot 44 formed through a support plate 32; and allowing the planetary pinion 42 to engage a transmission gear 36 for the small gear 6' of the lower roller 4' when the central axle 43 has approached the inner extremity of the slot 44 and to release such an enagagement of the planetary pinion 42 and transmission gear 36 when the central axle 43 has moved to the outer extremity of the slot 44. By such a construction, clutch means is provided by which positively-directed rotary power, which is created upon positively-directed rotation of the manual handle, is transmitted to the parallel rollers as feeding power for the printing frame but reverse rotary power, which is exerted when the handle is rotated in the opposite direction, is not transmitted to the parallel rollers.

Figure 9:
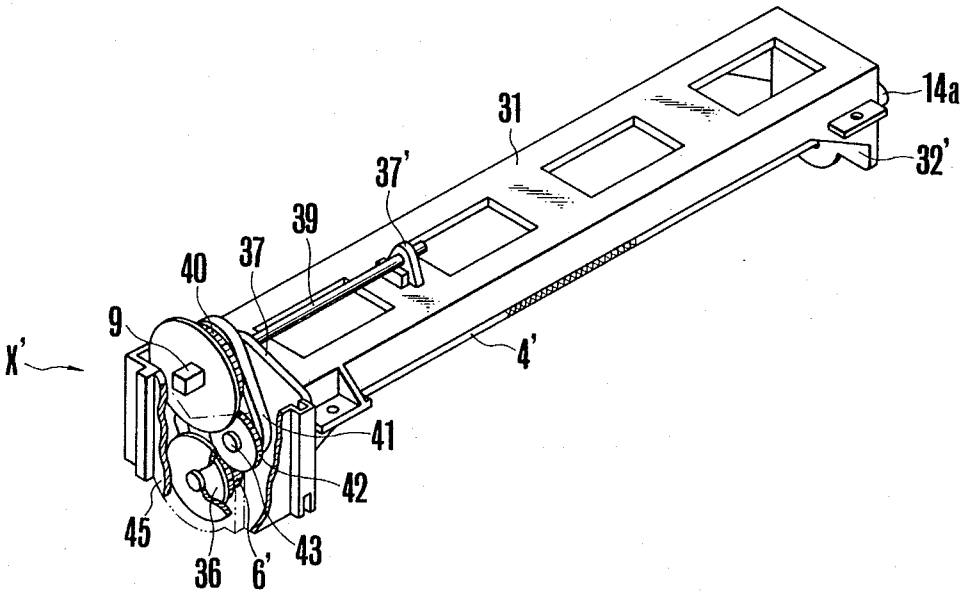
FIG. 9 is a partially broken perspective view of the main portion of a main mechanical unit.
Figure 10:
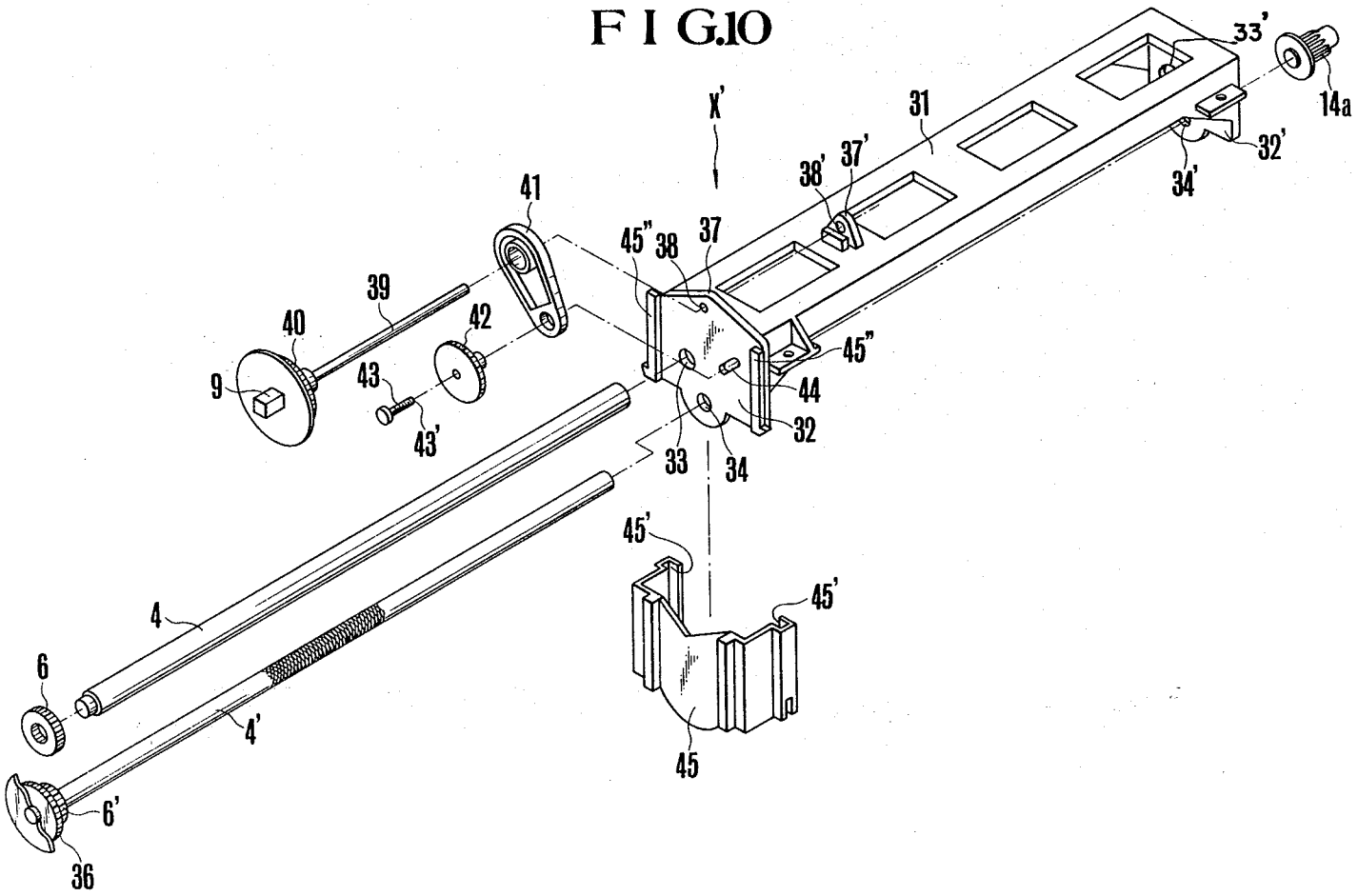
FIG. 10 is an exploded perspective view of the main mechanical unit.

In the above more preferred embodiment, the main mechanical unit X' is constructed as follows:

As best shown in FIGS. 9 and 10, there is provided frame 31 having a pair of support plates or downwardly extending support walls 32, 32' at both ends thereof, said frame and support walls being made of hard plastics. A pair of roller holes 33, 34; 33', 34' are respectively correspondingly formed through the support walls 32, 32' with upper and lower arrangement. The upper and lower rollers 4, 4' are removably inserted into the holes 33, 34; 33', 34' respectively from the left-hand side in the drawings to dispose the upper and lower rollers 4, 4' between the support plate or walls 32, 32' in parallel and rotatably.

The left-hand end of the upper roller 4 as well as both ends of the lower roller 4' are allowed to extend outwardly from their respective support walls 32, 32'. Small gears 6, 6' are fixedly provided at the left-hand ends of the upper and lower rollers 4, 4' and a belt wheel **14*a* is fixedly mounted on the right-hand end of the lower roller 4'. A transmission gear 36 is disposed outside the small gear 6' fixed on the left-hand end of the lower roller 4'** in such a manner that the former gear is in engagement with the latter gear.

A combination of upright support walls 37, 37' are provided respectively at the left-hand end of the frame 31 and at a position on the frame 31 in the neighborhood of the left-hand end of the frame 31. A pair of shaft holes 38, 38' are respectively formed through the upright support walls 37, 37', through which holes 38, 38' is rotatably and removably inserted a shaft rod 39. The left-hand end of the shaft rod 39 protrudes outwardly through the shaft hole 38, to which protruded end is fixedly secured a sun gear 40 equipped with the attachment shaft 9 of the handle 8 and from which protruded end is hung a swing piece 41. The planetary pinion 42, which engages the sun gear 40, is attached by means of an axle pin 43 to the lower tip portion of the swing piece 41. The inner end of the axle pin 43 is extended further thereby forming an extension 43' which is freely inserted into a guide slot 44 formed in the downward support wall 32. The planetary pinion 42 is brought into engagement with the transmission gear 36 when the extension 43' has taken a position at the inner extremity of the slot 44. A cover 45 is attached to the frame 31 at the left-hand end thereof by slidably engaging ridges 45'' with their respective grooves 45'.

Thus, the main mechanical unit X' is constructed.

Figure 6:
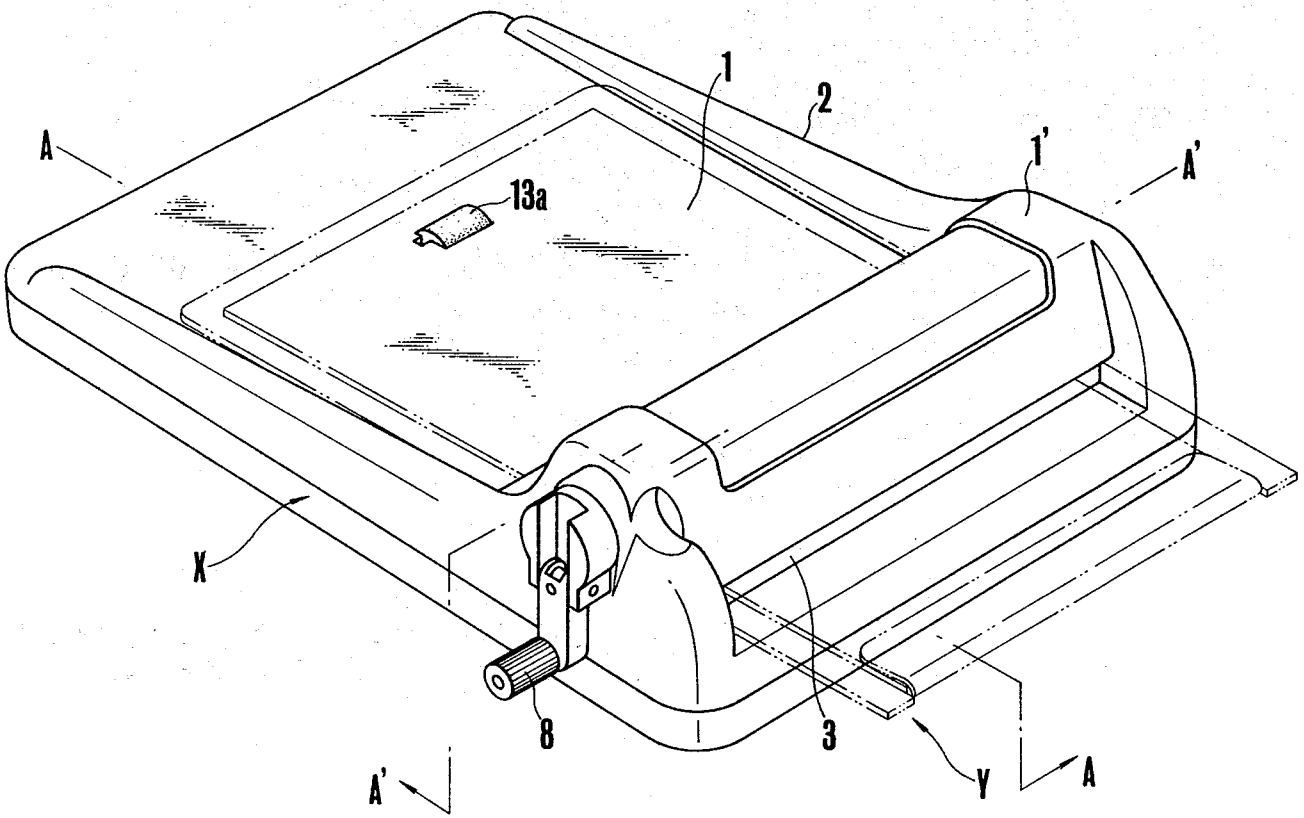
FIG. 6 is a perspective view showing the external appearance of the apparatus according to another embodiment of this invention.
Figure 7:
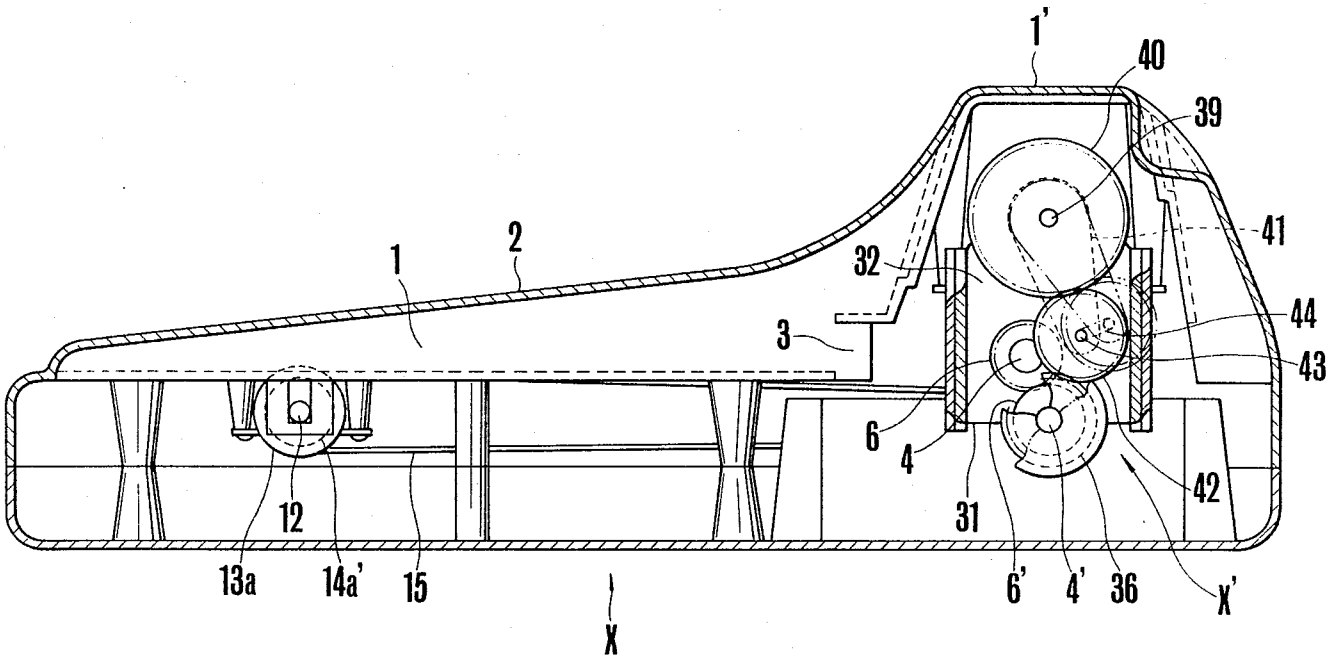
FIG. 7 is a cross-sectional view taken along the line A—A in FIG. 6.
Figure 8:
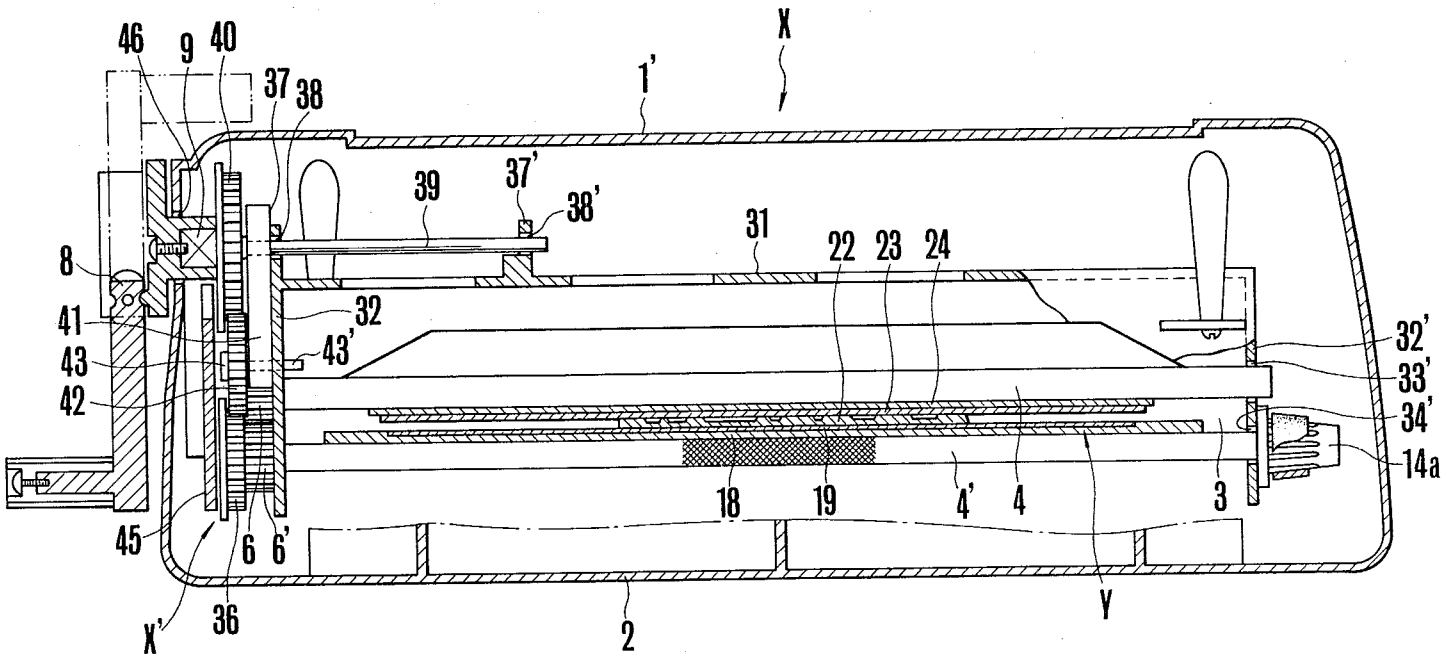
FIG. 8 is a cross-sectional view taken along the line A'—A' in FIG. 6.

Furthermore, as in the previously described embodiment, a housing 2 having a lowered portion 1 is formed as a separate member from the main mechanical unit X' as shown in FIG. 6 or 7. A through-path 3 is formed in the housing 2 in the same manner. The above-described main mechanical unit X' is disposed within the rear portion 1' of the housing 2 and is detachably secured to the housing 2 in such a manner that the upper and lower rollers 4, 4' are respectively positioned above and below the through-path 3. In addition, as shown in FIG. 8, a through-hole 46 is formed in the left-hand wall of the rear portion 1' of the housing 2 at a position corresponding to the handle attachment shaft 9 of the main mechanical unit X'. A foldable manual handle 8 is then fixedly attached to the handle attachment shaft 9 through the through-hole 46 and, as shown in FIG. 7, a transverse axle 12 is disposed below the bottom of the lowered portion 1 of the housing 2 in parallel with the upper and lower rollers 4, 4'. A belt wheel **14*a*' is fixedly mounted on the same end of the transverse axle 12 as the previously-described belt wheel 14*a*, and a rubber belt 15 is provided between the belt wheel 14*a*' and the belt wheel 14*a* fixedly secured to the right-hand end of the lower roller 4'. Furthermore, a feeding wheel 13*a*' is fixedly mounted on the transverse axle 12 at the midpoint thereof with an upper portion of the wheel 13*a*' protruding upwardly above the bottom surface of the lowered portion 1. The feeding wheels 13*a* and the upper and lower rollers 4, 4'** are rotated by a same distance at the peripheral surfaces thereof. The main body X is thus constructed.

Furthermore, the printing frame Y is constructed as a separate member from the main body X in the same manner as the aforementioned embodiment.

Thereafter, as in the afore-described embodiment, on a sponge sheet 19 of the support plate 18 are placed an embossed plastic plate 22, carbon paper 23 (preferably a single-faced carbon paper 24 with its carbon face directing upwards) and drawing paper in these sequence. A strip-like holding plate 20 is brought down inwardly to attract the same by a magnet 21 thereby holding the carbon paper 23 and drawing paper 24 in place at the rear edges thereof.

Then, the printing frame Y carrying the embossed plate 22, carbon paper 23 and drawing paper 24 held together thereon is inserted from the lowered portion of the housing 2 to the front end opening of the through path 3', making the rear edge of the printing frame hold between the parallelly-disposed upper and lower rollers 4, 4', and the printing frame Y is then fed frontwardly by turning the manual handle 8 to rotate the parallelly-disposed upper and lower rollers 4,4' and the feeding wheel **13*a*, thereby transferring the pattern of the embossed plate 22 onto the drawing paper 24 by the aid of the carbon paper 23 under the pressure of said rollers 4, 4'**.

While specific embodiments of the invention have been shown and described in detail to illustrate the application of the principles of the invention, it will be understood that the invention may be embodied otherwise without departing from such principles.

What is claimed is:

1. A printing apparatus for obtaining an outline design for child's painting and other simple printed materials, comprising; a main body including a main mechanical unit equipped with upper and lower rollers disposed in parallel, spaced from each other and adapted to be rotated by rotary driving means; a printing frame which is adapted to receive thereon an embossed pattern plate, carbon paper and a sheet of paper in this order and allowed to pass between the said parallel-rollers; said main body comprising a housing forming in its upper surface a lowered portion having a flat bottom surface, opening upwardly and frontwardly of the housing; with a width approximately equivalent to that of said printing frame; a through-pass for said printing frame extending longitudinally of the housing from the front wall to the rear end of the rear portion of the housing at substantially the same level and width as the level and width of the bottom surface of said lowered portion, the upper and lower rollers being disposed within the rear portion of the housing horizontally over the substantially entire width of the housing in such a manner that the upper and lower rollers are positioned respectively above and below said through-pass at a space substantially equal to the thickness of said printing frame; support means to rotatably receive said upper and lower rollers at both ends thereof; said support means comprising a plate-like frame equipped with a pair of downwardly extending support walls at both extremities thereof, and including through said support walls two pairs of holes in upper and lower relationship for receiving respectively said upper and lower rollers which are disposed transversely, parallel and rotatably between the support walls; a transmission gear connected to one of said rollers; a clutch connected between said drive means and said parallel rollers which, when the driving means is operated in a positive direction, transmits its positively directed rotary power to the rollers to feed the printing frame forward and, when in the reverse direction, does not transmit its reversely directed rotary power to the rollers; said clutch comprising a sun gear fixedly mounted to a drive shaft of the driving means; a planetary pinion which is in engagement with the sun gear; a freely inserted central axle of the planetary pinion disposed for movement in a guide slot formed in the support wall so as to bring the planetary pinion into engagement with said transmission gear when the central axle of the planetary pinion has approached the inner extremity of the slot and to release said engagement when the central axle has moved to the outer extremity of the guide slot whereby rotary motion in the positive direction will cause said planetary pinion to move to the inner extremity of said slot and thereby transmit rotary motion to said rollers via said transmission gear.

2. A printing apparatus according to claim 1, wherein each of said upper and lower rollers is fixedly equipped, at one of its extremities, with a gear each having the same diameter and teeth number and being in engagement with each other, said rollers being rotated by said driving means which further comprises a manual handle connected to said sun gear system.

3. A printing apparatus according to claim 2, wherein a rubber roller to prevent the upper roller from warping is provided above the said upper roller at the middle portion thereof so as to be rotatably in contact with the surface of the upper roller.

4. A printing apparatus according to claim 3, wherein the feeding wheels and the upper and lower rollers have dimentions so that each outer peripheral surface thereof rotates by the same distance.

5. A printing apparatus according to claim 1, wherein said main body further includes a transverse axle rotatably provided in parallel to the upper and lower rollers at approximately middle portion of and below said flat bottom surface of the lowered portion of the housing and fixedly provided thereon with at least one feeding wheel in such a manner that the upper portion of the feeding wheel protrudes above the flat bottom surface of the lowered portion of the housing, said transverse axle rotating co-operatively with the rollers by means of an endless belt extending between belt wheels fixedly mounted on the one end of the transverse axle and the corresponding end of the lower roller, respectively.

6. A printing apparatus according to claim 1, wherein said printing frame comprises a base plate having integrally at the peripheral edge thereof an upwardly surrounding frame to form in its inside area a lowered flat area with the depth substantially equal to the thickness of the embossed pattern plate to be placed thereon; a resilient sheet spread on the bottom of the said base plate; and a holding-strip pivotally mounted on the rear edge of the base plate in order to safely hold the embossed pattern plate, the carbon paper and the sheet of paper to be placed thereon.

7. A printing apparatus according to claim 6, wherein said base plate includes a magnet mounted on the upper surface of the rear end of the base plate to attract a strip-like plate.

* * * * *

UNITED STATES PATENT AND TRADEMARK OFFICE

CERTIFICATE OF CORRECTION

PATENT NO. : 4,253,394

DATED : March 3, 1981

INVENTOR(S) : Eiji Tada

It is certified that error appears in the above—identified patent and that said Letters Patent is hereby corrected as shown below:

In Claim 1, line 12, change the semicolon after "housing" to a comma.

In Claim 4, line 1, change "3" to --5--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*